United States Patent [19]

Dowd et al.

[11] 4,013,307

[45] Mar. 22, 1977

[54] DUAL POSITION STABILIZER

[75] Inventors: Allyn C. Dowd, Sterling Heights; John D. Rogowski, Bloomfield Hills, both of Mich.

[73] Assignee: Massey-Ferguson Inc., Detroit, Mich.

[22] Filed: Sept. 22, 1975

[21] Appl. No.: 615,445

[52] U.S. Cl. ..... 280/764

[51] Int. Cl.[2] ..... B60S 9/02

[58] Field of Search ..... 280/150.5, 764; 212/145; 308/62

[56] References Cited

UNITED STATES PATENTS

| | | | |
|---|---|---|---|
| 3,310,181 | 3/1967 | Symmank | 280/764 |
| 3,630,544 | 12/1971 | Grisham | 280/764 |
| 3,866,946 | 2/1975 | Robinson | 308/62 |

*Primary Examiner*—Robert R. Song
*Attorney, Agent, or Firm*—Thomas P. Lewandowski

[57] ABSTRACT

Stabilizing apparatus for vehicles supporting load handling equipment such as tractors mounted with backhoes in which the stabilizing apparatus is movable vertically from a transport position to a ground engaging position and also may be moved horizontally to vary the angular disposition of the stabilizers relative to the vehicle to engage the ground at longitudinally spaced positions.

11 Claims, 8 Drawing Figures

DUAL POSITION STABILIZER

This invention relates to mobile load handling equipment such as a tractor with a backhoe and more particularly to stabilizers for such equipment.

Mobile load handling equipment, such as excavators and backhoes, is frequently mounted on self propelled vehicles such as tractors, to be supported for transport on the road between work sites and for load handling operations at the work site.

Usually such equipment is provided with a stabilizing arrangement which engages the ground at lateral opposite sides of the vehicle to support the weight of the vehicle and the loads being manipulated to form a more stable and wider operating platform than can be provided by the ground engaging wheels and the suspension system of the vehicle. Usually such stabilizers are movable between transport and ground engaging position to a set laterally fixed position relative to the vehicle. In certain operations of such equipment, it also becomes desirable to move the stabilizers in a fore and aft direction of the vehicle. For example, in certain operations when the backhoe is being used as a crane to move loads, not only vertically but also in a fore and aft direction relative to the vehicle, it is desirable to provide additional stability by displacing the stabilizers, longitudinally toward the rear of the vehicle. An example of utility is in tiling operations in which the backhoe with conventionally positioned stabilizers is used to dig a trench and subsequently the backhoe is used as a crane to pick up lengths of tile stored adjacent to the ditch and to place the tiles in position within the ditch. In the latter operation it is desirable to provide added longitudinal stability.

Prior arrangements affording movement of the stabilizers in a fore and aft direction are heavy and cumbersome and add weight and cost to the equipment. Moreover, such arrangements have required the use of additional tools and difficult manual manipulation of the stabilizers to their selected position for exact alignment to afford operation of locking devices and the like.

It is an object of the invention to provide a stabilizer for mobile load handling equipment which may be moved between transport positions and ground engaging positions and also may be adjusted to selected ground engaging positions spaced longitudinally of the vehicle.

Another object of the invention is to provide stabilizing structure in which stabilizers on load handling equipment may be horizontally displaced angularly of the vehicle to selected ground engaging positions.

Still another object of the invention is to provide stabilizers for material handling equipment in which the horizontal angular position of stabilizers may be changed relative to the vehicle without manual effort on the part of the operator by moving the vehicle relative to the ground engaged stabilizers.

Stabilizing apparatus for vehicles supporting load handling equipment has been provided in which stabilizer arms are mounted at opposite sides of the vehicle for movement between a transport position and a position in which the stabilizers extend substantially laterally from the vehicle. The stabilizers may also be horizontally adjusted from their position extending laterally from the vehicle to a new position in which the ground engaging portions of the stabilizer are disposed longitudinally of the original position. The horizontal angular adjustment of the stabilizer is afforded by a bearing mounting for the horizontal pivot shaft about which the stabilizers move, such that the bearing is moved to a selected one of two positions in a horizontal path, thereby changing the angular disposition of the stabilizers when they are in their ground engaging position. The bearing mounting guides the bearing so that movement between its positions may be accomplished by moving the vehicle relative to the stabilizers while they are engaged with the ground. One embodiment of the invention employs the use of self aligning bearings for the stabilizer support shaft and another embodiment of the invention employs conventional bearings with a support for such bearings which permits alignment of the shafts in a selected one of its two positions.

Figure 1:
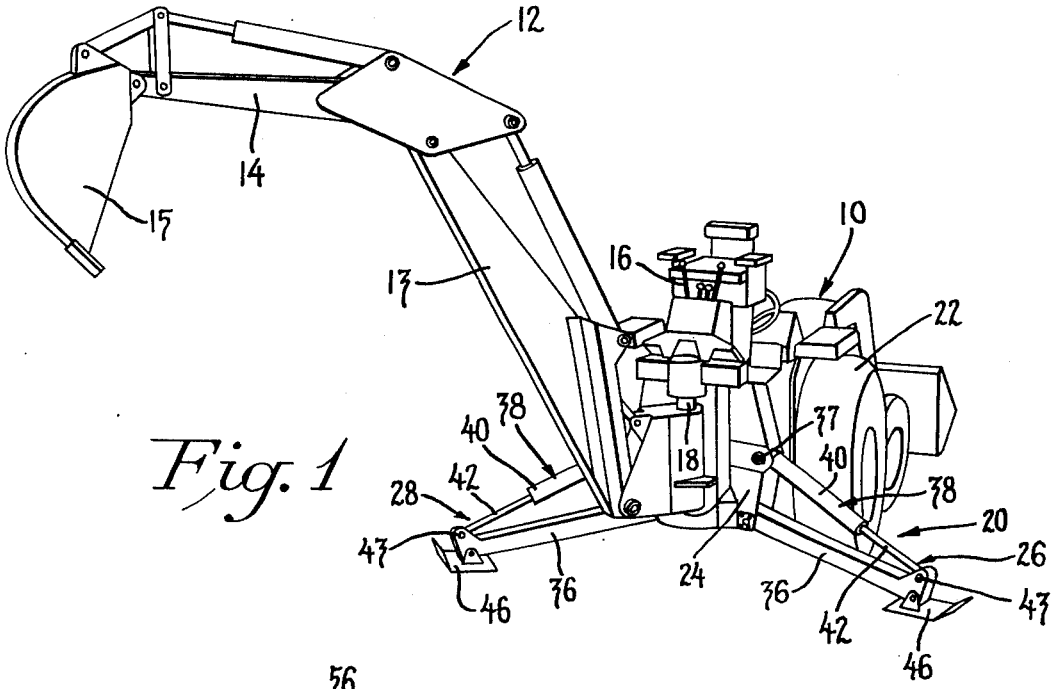
FIG. 1 is a perspective view of a load handling equipment which includes a tractor and attached backhoe which is provided with stabilizers embodying the present invention.

Referring to the drawings, and particularly to FIG. 1, load handling equipment in a form of a tractor mounted backhoe is illustrated. The equipment includes a tractor 10 and a backhoe 12 having a boom 13, a dipstick 14 and a bucket 15. Controls 16 on the tractor are manipulated to excavate and move loads in the bucket 15 vertically and also to swing the load to either side of the tractor around a vertical pivot axis for the backhoe indicated at 18. The load handling equipment includes, stabilizing structure embodying the invention generally designated at 20 which is supported from the tractor 10 to the rear of rear driving wheels 22.

The stabilizing structure includes a weldment or frame work 24 which extends transversely of the tractor and supports stabilizer assemblies 26 and 28 at opposite sides of the tractor. The stabilizer assemblies 26 and 28 are generally identical identical and only stabilizer assembly 26 at the right side of the tractor will be referred to in detail.

Figure 2:
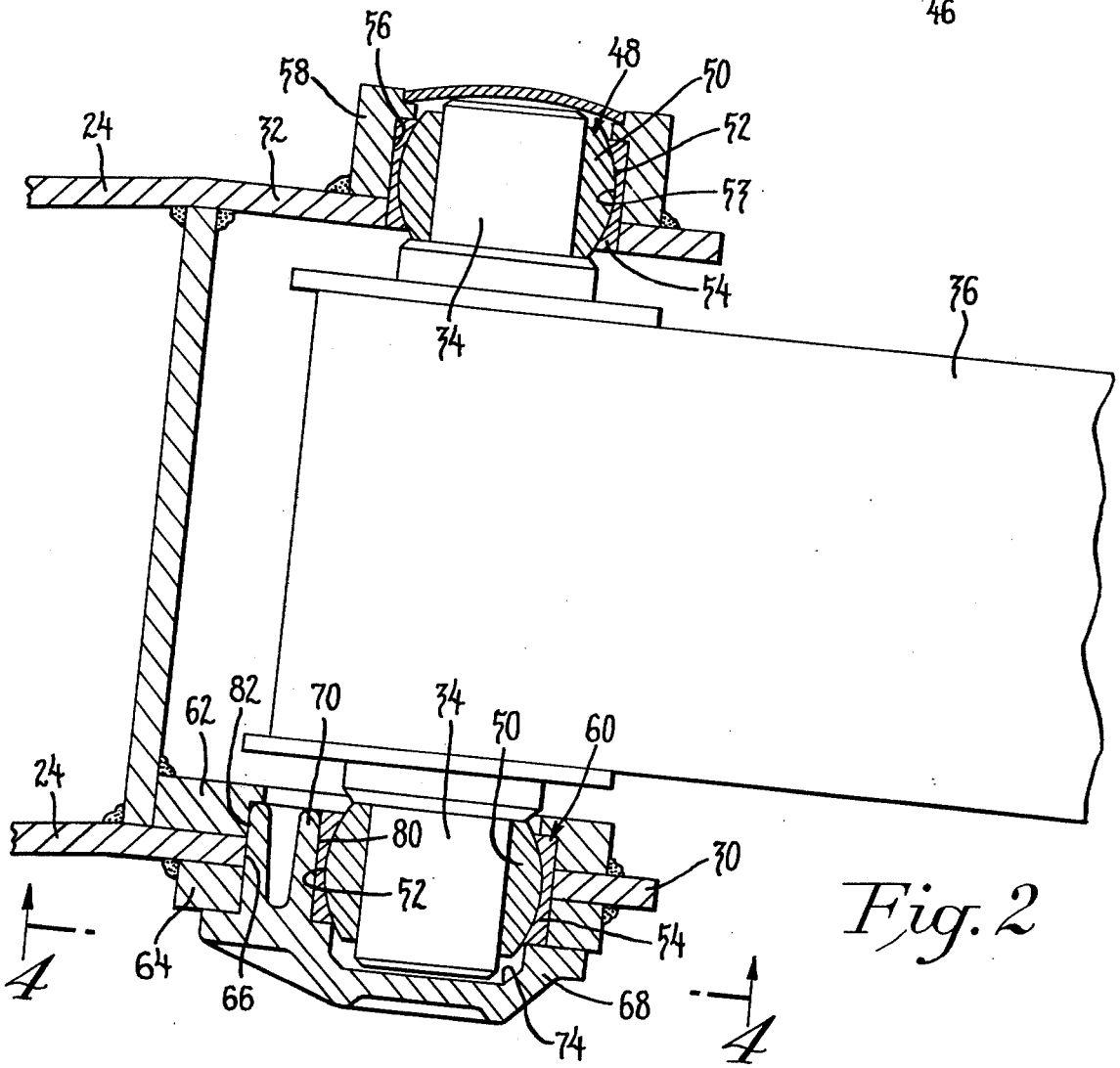
FIG. 2 is a cross-sectional view at an enlarged scale of a portion of the stabilizing mechanism shown in FIG. 1.
Figure 3:
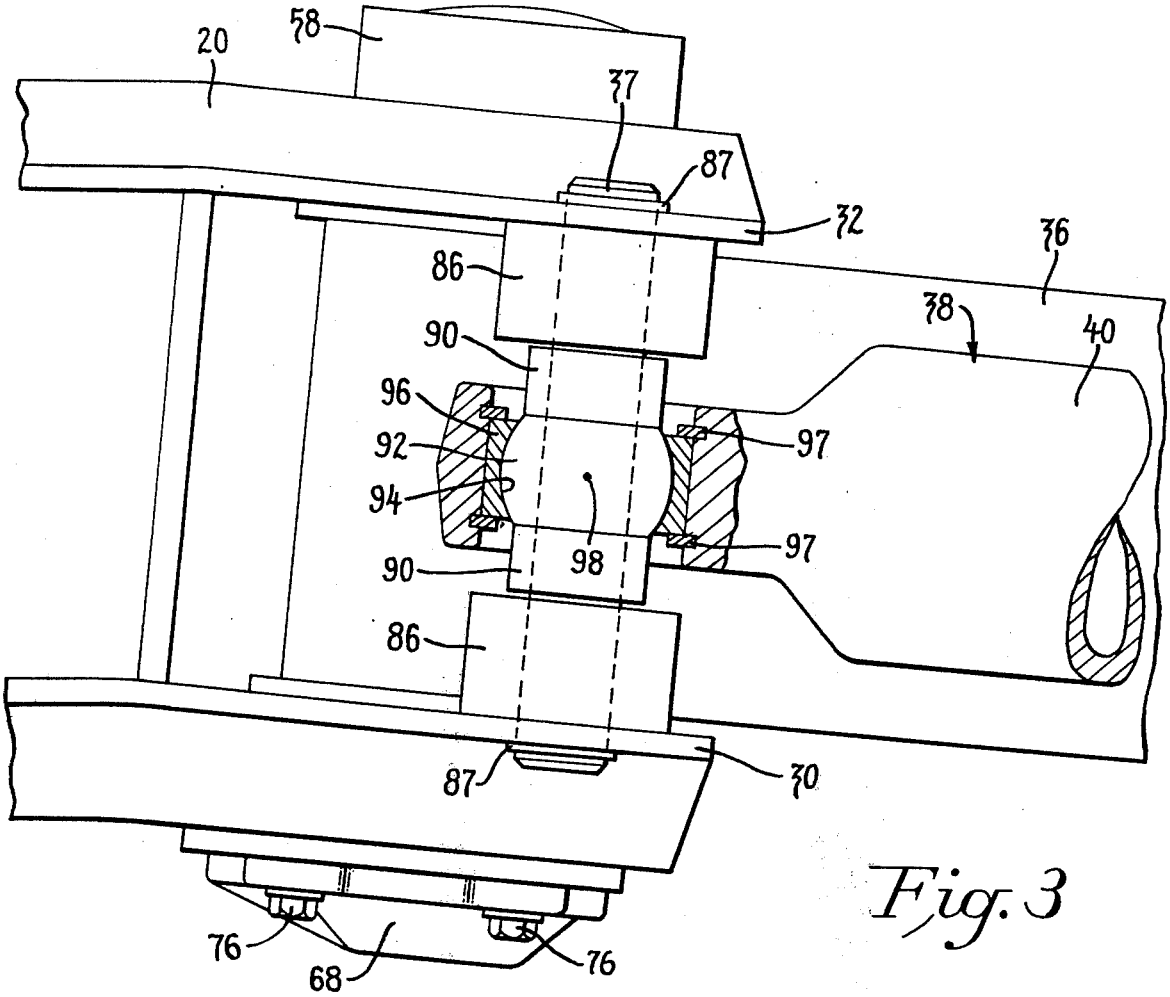
FIG. 3 is a view partly in sections and at an enlarged scale of another portion of the stabilizing equipment shown in FIG. 1.

Referring to FIG. 2, the support frame work 24 includes a pair of generally parallel disposed plates 30 and 32, which are held in fixed space apart relationship to each other. The plates 30 and 32 supports a shaft 34 by which one end of a strut 36 of the stabilizer mechanism is pivoted relative to the tractor. As seen in FIG. 3, the plates 30 and 32 also support a shaft 36 forming a pivot mounting for one end of a hydraulic actuator 38. The hydraulic actuator 38 includes a hydraulic cylinder 40 and an extensible rod 42, the free end of which is pivoted at 43 as seen in FIG. 1, to the outboard end of the strut or supporting arm 36. By manipulation of hydraulic controls on the tractor, the stabilizers 26 and 28 are moved between a transport position in which the support strut 36 is disposed generally vertically relative to the tractor, to a position in which a stabilizer shoe 46 pivoted to the end of the support arm may be moved downwardly to ground engaging position.

Referring again to FIG. 2, the shaft 34 forming a pivot for the stabilizer strut 36 is supported at one end by a self aligning bearing assembly 48.

The self aligning bearing assembly 48 includes a bearing element 50 which journals one end of the shaft 34. The outer surface 52 of the bearing element 50 is generated from a sphere and is complementary to a surface formed by a bushing 54. The bushing 54 is seated in a bearing recess 56 formed in a bracket element 58 welded to the plate member 32.

As seen in FIG. 2, the opposite end of the shaft 34 is journalled in a similar bearing assembly 60 having a bearing element 50 and bearing bushing 54 identical to the bearing assembly 48.

Figure 4:
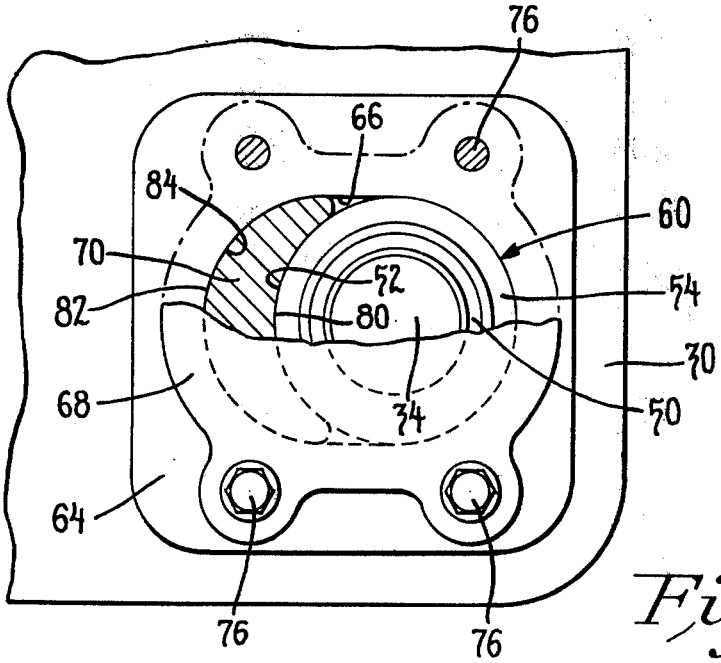
FIG. 4 is a sectional view taken on line 4—4 in FIG. 2.

The bearing assembly 60 is supported relative to the plate member 30 by a bracket structure which includes plates 62 and 64 welded to opposite sides of the plate member 30 and forming with the latter a recess 66 which receives the bearing assembly 60 and a bearing support member 68. As seen in FIG. 4, the recess 66 is generally oval so that the bearing assembly 60 may be supported toward one end of the cavity 66 and a crescent shaped portion 70 of the bearing support 68 is supported at the opposite end of the cavity 66.

Figure 6:
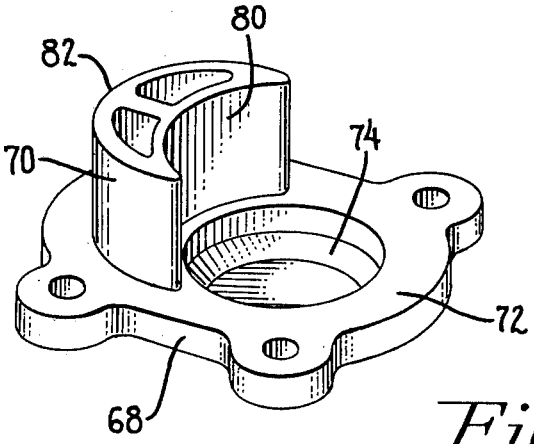
FIG. 6 is perspective view of a bearing block employed in the stabilizing equipment.

Referring to FIG. 6, the bearing support member 68 is a unitary casting having a plate like portion 72 formed integrally with the crescent portion 70. The plate 72 is disposed to one side of plate 64 and has a recess 74 which as seen in FIG. 2, affords clearance for the end of the shaft 34. The bearing support member 68 is held in position by studs 76 passing through openings in the bearing support member 68 and threadably engaged with threaded openings in the plate element 64.

Referring now to FIG. 4, the crescent shaped portion 70 of the bearing support member 68 has a concave surface 80 of the same curvature as the outer surface 52 of the bearing bushing 54. A convex surface 82 of the crescent shaped member 70 also is of the same curvature as the bearing assembly 60 and the end wall 84 of the recess 66. The bearing assembly 60 may be positioned as shown in FIG. 4, at the right side of the cavity 66. The spacing of the studs 76 is such that the bearing assembly 60 may also be positioned at the left end of the cavity 66 with the crescent shaped portion 70 of the bearing support member 68 at the right end of the cavity 66.

The cylinder 40 of the hydraulic actuator 38 is supported relative to the frame 20 as best seen in FIG. 3. The pivot shaft 37 is journaled in bosses 86 fixed to the frame members 30 and 32 and is held in position by snap rings 87 which prevent axial displacement of the shaft 37. Disposed between the bosses 86 and on the shaft 37 is a bearing member 90 a medial portion of which forms a generally spherical bearing surface 92. The bearing surface 92 is complementary to a bearing seat surface 94 formed in the bushing 96. The bushing 96 is held in position against movement axially of the shaft 37 by means of snap rings 97. The bearing 90 and its bushing 96 affords limited universal angular displacement of the hydraulic actuator 38 relative to the shaft 37.

Figure 5:
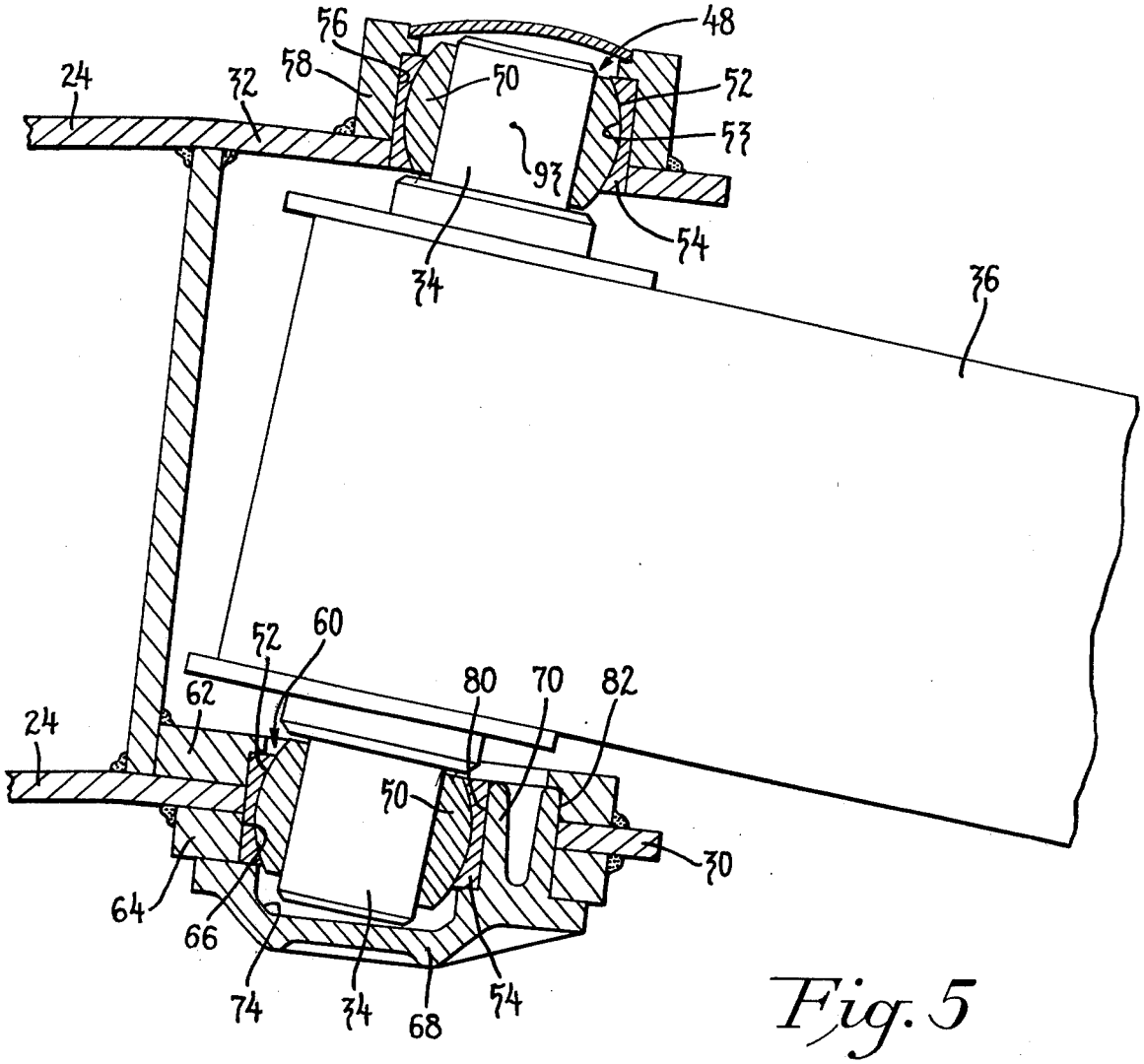
FIG. 5 is a view similar to FIG. 2 but showing another operating position of the stabilizer mechanism.

During usual operations of the backhoe 12 the stabilizers 26 and 28 are positioned to extend transversely of the tractor 10 to afford lateral stability preventing tilting of the equipment as loads are moved from side to side by the backbone 12 about the pivot 18. However, during certain crane type of operations in which loads are repeatedly moved in a substantially longitudinal direction relative to the tractor, it is desirable to provide additional longitudinal stability, this is accomplished by changing the horizontal angular position of the stabilizers 26 and 28. The studs 76 and the bearing support member 68 are removed and the bearing assembly 60 is shifted from the right end of the cavity 66, as seen in FIGS. 2 and 4 to the left end of the cavity, as seen in FIG. 5. This causes the shaft 34 to pivot with the bearing 50 at the opposite end of the shaft about the point indicated at 93. Thereafter, the bearing support member 68 is rotated or turned end for end in a generally vertical plane so that the crescent portion 70 is disposed in the right end of the cavity and the stud members 76 are replaced to hold the bearing support member 68 in position.

During movement of the stabilizer arm 36 to the position shown in FIG. 5, the inboard end of the hydraulic actuator 38 is caused to pivot slightly about the point indicated at 98 in FIG. 3. With the stabilizer arm 36 in either of its positions illustrated in FIG. 2 or FIG. 5, the stabilizer assembly 26, may be moved between the ground working position shown in FIG. 1 or its elevated transport position in which the actuator arm 36 is in a generally vertical position relative to the tractor 10.

Under actual operating conditions, when it is desired to move the stabilizer assemblies 26 and 28 from their laterally extending position to an angularly disposed position, the operator causes the stabilizer units to engage with the ground after which the bearing support assemblies 68 are removed by removal of the studs 76. Thereafter, the operator drives the tractor 10 to move it forwardly a slight amount. This causes the shoes 46 at the outboard ends of the stabilizers to remain stationary in engagement with the ground and to pivot the stabilizers 26 and 28 so that the stabilizer arms 36 pivot about the points 93 and the hydraulic actuators pivot about the points 98 causing the bearing assemblies 60 to move to the opposite ends of the cavities 66 so that the outer surface of the bearing assemblies 60 comes into engagement with the curved end surfaces 84. The bearing support member 68 may then be easily repositioned by rotating it end for end in a vertical plane and disposing the crescent shaped portion 70 in the opposite end of the cavity. Similarly, when it is desired to return the stabilizers 26 and 28 from a rearwardly angled position to their laterally extending position, the bearing support members 68 are again removed and the tractor is moved rearwardly with the ground engaging shoes 46 in engagement with the ground causing the bearing assemblies 60 to be displaced horizontally in their cavities 66. Thereafter, the bearing support members 68 may be replaced and fixed in position by means of the studs 76.

With the stabilizer arms 26 and 28 in either of their horizontally disposed positions, the stabilizers 26 and 28 may be moved between their ground engaging position, as seen in FIG. 1, and a transport position in which the stabilizer struts 36 are in a substantially vertical position at opposite sides of the tractor.

Figure 7:
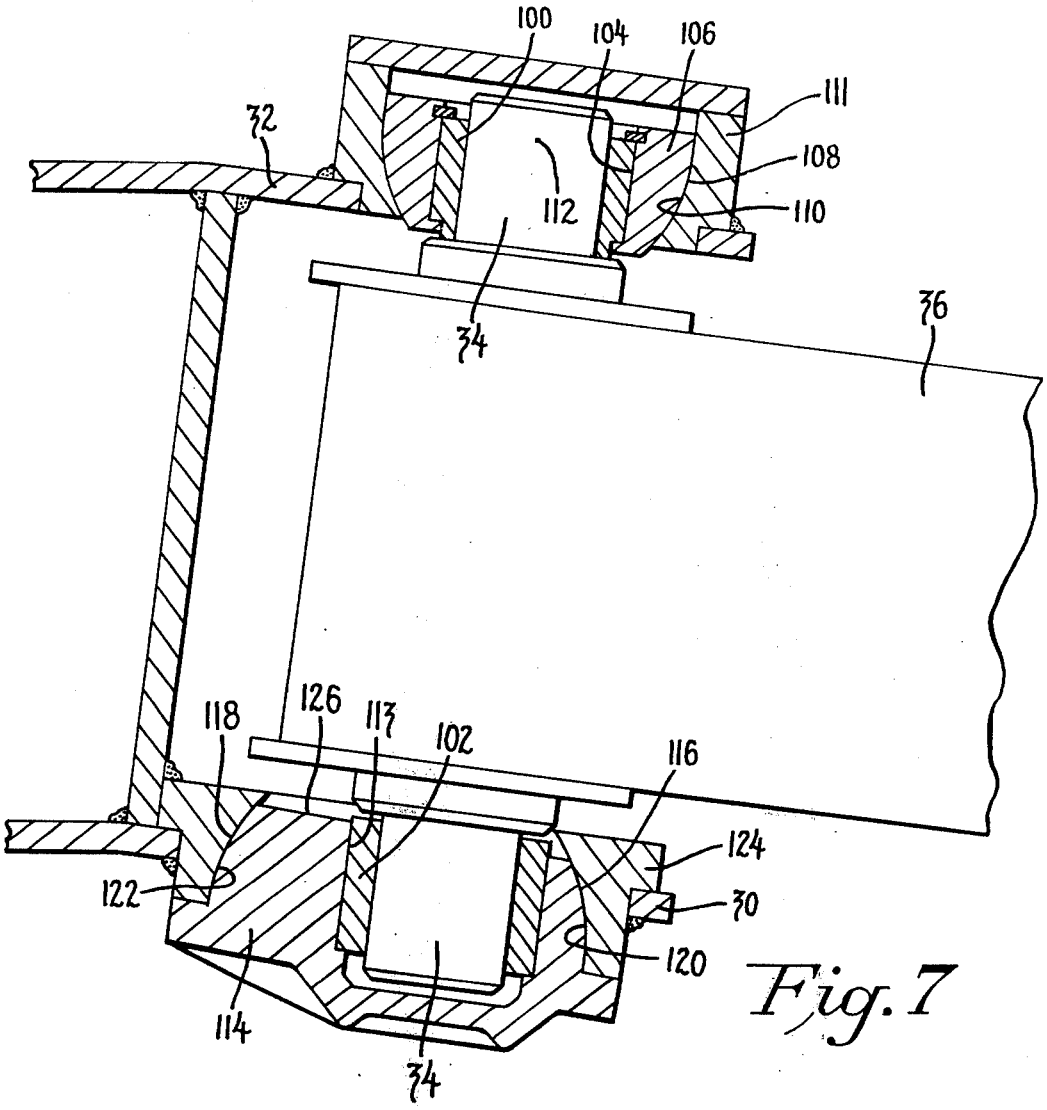
FIG. 7 is a view similar to FIG. 2 but showing another embodiment of the invention.
Figure 8:
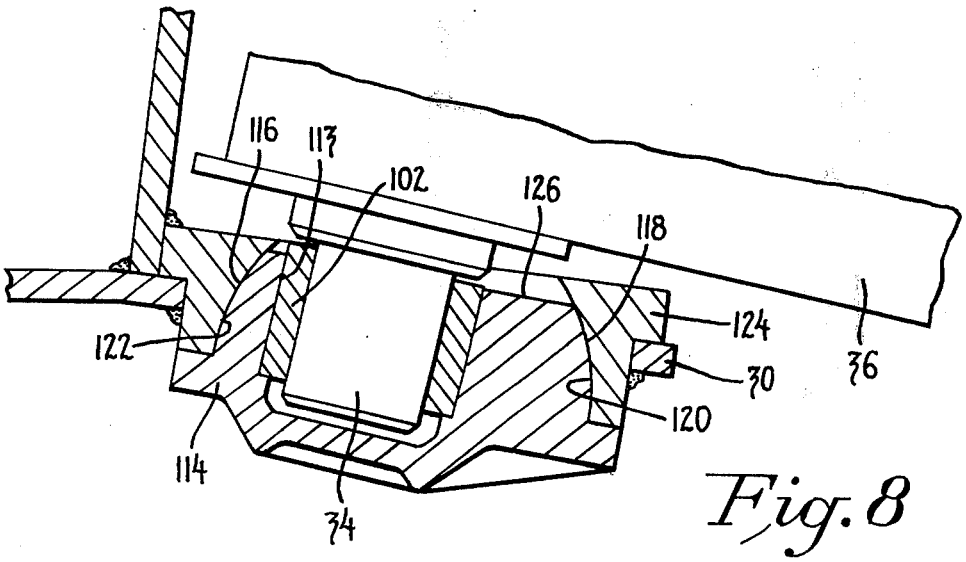
FIG. 8 shows a portion of the structure in FIG. 7 but illustrates another operating position of the stabilizer mechanism.

Referring now to FIGS. 7 and 8, another embodiment of the invention is disclosed in which the shaft 34 is journaled at its opposite ends for rotation in conventional tubular type bearings 100 and 102. The bearing 100 is seated in a recess 104 formed by a bearing support member 106. The bearing support member 106 has oppositely facing curved surfaces 108 which are complementary to facing curved surfaces 110 formed in a bearing bracket 111 welded to the plate member 32. The curved surfaces are on radii having their center on the axis of the shaft 34 at the point indicated at 112 to accommodate slight horizontal angular displacement of the shaft 34.

The bearing 102 is received in a recess 113 formed in a bearing support member 114. The bearing support member 114 has oppositely facing curved surfaces 116 and 118 which are complementary to, respectively, facing curved surfaces 120 and 122 formed in a bracket element 124 welded to the plate 30. The bearing receiving recess 113 is offset toward one side of the bearing support member 114 adjacent to the curved surface 116. The bearing support member 114 may be held in position by means of studs 76, such as those shown in connection with the bearing support member 68 in FIG. 4.

It will be noted that the axis of the bore forming the recess 113 is disposed at a slight angle to the face 126 of the bearing support member 114 so that when the bearing support member 114 is in the position as shown in FIG. 7, the bearing 102 is properly aligned on the shaft 34. To change the angle of the shaft 34, the bearing support member 114 is removed and the shaft 34 is shifted to the position shown in FIG. 8. During such movement the bearing support member 106 and bracket 111 act as a self aligning bearing means to accommodate angular change of the shaft 34. The bearing support member 114 may be replaced in position after the angle of the shaft has been changed with the bearing receiving recess 13 positioned to the left, that is, the bearing support member 114 has been rotated 180°. In the position shown in FIG. 8 the angle of the bore of the recess 14 is disposed at an angle displaced in the opposite direction from the axis in FIG. 7 so that the shaft 34 is properly aligned in the bearing 102.

In the position shown in FIG. 7 the stabilizers 26 and 28 will extend substantially laterally from opposite sides of the tractor and in the position shown in FIG. 8 the stabilizers will be angularly displaced in a horizontal direction to locate the ground engaging shoes 46 farther rearward relative to the tractor.

A stabilizing apparatus for vehicles supporting load handling equipment has been provided in which the ground engaging position of the stabilizer relative to the vehicle may be varied angularly and horizontally to position the ground engaging portions of the stabilizers in selected positions spaced longitudinally of the vehicle making it possible for the stabilizing apparatus to be used in its most advantageous position to prevent tilting of the vehicle laterally or to reposition the stabilizers to add stability to the vehicle when loads are being moved longitudinally.

The embodiments of the invention in which an exclusive property or privilege is claimed as defined as follows:

1. Stabilizing apparatus for a vehicle supporting load handling equipment comprising a frame work having an elongated Cavity rigidly attached to each side of the vehicle; ground engageable support means, a strut member supporting said ground engageable support means relative to said vehicle, a shaft supporting said strut for pivotal movement about a horizontal axis for swinging movement of said ground engageable support means between a transport position and a ground engaged position, a bearing received in said cavity journaling one end of said shaft to said frame work, bracket means holding said bearing in a selected one of two positions in said cavity in which said shaft is displaced angularly and horizontally about its other end relative to said vehicle, including a bracket member, a plate and a bearing engaging pad on said, means detachably securing said plate to said plate, said plate covering one end of said shaft and said bearing in the attached position, said bearing engaging pad projecting from said plate toward said bearing to provide support on one side of said bearing with said plate in one position and on the other side of said bearing when said plate is rotated a half turn generally about the axis defined by said shaft for positioning said ground engageable support means in selected positions displaced longitudinally of said vehicle.

2. The combination of claim 1 in which said bearing is a self aligning bearing.

3. The combination of claim 1 in which the other end of said shaft is journaled in self aligning bearing means.

4. The combination of claim 1 and further comprising hydraulic means for swinging said ground engageable support means between transport and ground engaging positions, one end of said hydraulic means being supported for horizontal pivotal movement during horizontal angular displacement of said shaft.

5. The combination of claim 1 wherein said bracket means includes a bearing receiving surface to support said bearing opposite the side of said bearing engaging pad.

6. Stabilizing apparatus for a vehicle supporting load handling equipment comprising; ground engageable support means, a strut member supporting said ground engageable support means relative to said vehicle, a shaft supporting said strut for pivotal movement about a horizontal axis for swinging movement of said ground engageable support means between a transport position and a ground engaged position, a bearing journaling one end of said shaft, bracket means forming an elongated cavity, a support member disposed in said cavity and forming a bearing receiving cavity adjacent one end of said elongated cavity, said support member being movable to a selected one of two positions to form said bearing receiving cavity adjacent the opposite end of said elongated cavity for positioning said ground engageable support means in selected position displaced longitudinally of said vehicle.

7. The combination of claim 6 in which said bearing has an outer cylindrical surface, said cavity having surfaces at opposite ends thereof complementary to a portion of the outer cylindrical surface of said bearing, said support member having a surface in said elongated cavity complementary to the remaining portion of the outer cylindrical surface of said bearing, said surface of said support member and said surface at one end of said elongated cavity forming said bearing receiving cavity.

8. The combination of claim 6 in which said elongated cavity extends generally horizontally and in which opposite ends of said elongated cavity are similarly curved, said support member having opposite ends presenting curved surfaces complementary to the curved surfaces at the ends of said elongated cavity, said bearing being supported by said support member at one end thereof.

9. The combination of claim 6 in which said bearing is supported for horizontal sliding movement in said elongated recess upon removal of said support member.

10. The combination of claim 9 in which said bearing is movable from one end to the other of said elongated cavity upon relative movement of said stabilizer and said vehicle.

11. The combination of claim 10 in which said stabilizer is movable relative to said vehicle upon movement of the latter while said ground engaging support means are engaged with the ground.

* * * * *

UNITED STATES PATENT OFFICE

CERTIFICATE OF CORRECTION

Patent No. 4,013,307 Dated March 22, 1977

Inventor(s) Allyn C. Dowd et al.

It is certified that error appears in the above-identified patent and that said Letters Patent are hereby corrected as shown below:

Claim 1, line 2, after "comprising" insert --;--.

line 3, "Cavity" should be --cavity--.

line 4, after "vehicle" change ";" to --,--.

line 15, delete "a bracket member,".

line 16, after "said" insert --plate--.

line 17, delete "plate" second occurrence and insert in place thereof --bracket means--.

Claim 6, line 16, change "position" to --positions--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*